US008236394B2

(12) United States Patent
Tanaka et al.

(10) Patent No.: US 8,236,394 B2
(45) Date of Patent: Aug. 7, 2012

(54) RECORDING MEDIUM

(75) Inventors: Takatoshi Tanaka, Kawasaki (JP); Hiroshi Asakawa, Ebina (JP); Hitoshi Nagashima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 51 days.

(21) Appl. No.: 13/023,803

(22) Filed: Feb. 9, 2011

(65) Prior Publication Data

US 2011/0217488 A1 Sep. 8, 2011

(30) Foreign Application Priority Data

Mar. 3, 2010 (JP) ..... 2010-046402

(51) Int. Cl.
*B41M 5/00* (2006.01)

(52) U.S. Cl. ..... 428/32.24; 428/32.25; 428/32.31; 428/32.32; 428/32.34; 428/32.35

(58) Field of Classification Search ..... 428/32.24, 428/32.25, 32.31, 32.32, 32.34, 32.35
See application file for complete search history.

(56) References Cited

U.S. PATENT DOCUMENTS

| | | | | |
|---|---|---|---|---|
| 4,460,637 | A | 7/1984 | Miyamoto et al. | |
| 4,780,356 | A * | 10/1988 | Otouma et al. | 428/32.37 |
| 5,955,185 | A | 9/1999 | Yoshino et al. | |
| 5,965,252 | A | 10/1999 | Santo et al. | |
| 6,848,781 | B2 | 2/2005 | Ogino et al. | |
| 7,291,361 | B2 | 11/2007 | Ogino et al. | |
| 7,662,452 | B2 | 2/2010 | Nagashima et al. | |
| 7,846,516 | B2 | 12/2010 | Kamo et al. | |
| 7,867,586 | B2 | 1/2011 | Kamo et al. | |
| 2001/0036552 | A1 | 11/2001 | Otani et al. | |
| 2002/0012626 | A1 | 1/2002 | Tanaka et al. | |
| 2002/0012629 | A1 | 1/2002 | Yoshino et al. | |
| 2002/0197452 | A1* | 12/2002 | Ichinose et al. | 428/195 |
| 2003/0039808 | A1* | 2/2003 | Ichinose et al. | 428/195 |
| 2003/0099816 | A1* | 5/2003 | Liu et al. | 428/195 |
| 2006/0045998 | A1 | 3/2006 | Kitamura et al. | |
| 2010/0098866 | A1 | 4/2010 | Nagashima et al. | |
| 2010/0310795 | A1 | 12/2010 | Tanaka et al. | |

FOREIGN PATENT DOCUMENTS

| | | | |
|---|---|---|---|
| DE | 3237381 | A1 | 7/1983 |
| EP | 0 701 904 | B1 | 8/1999 |
| EP | 1138513 | A1 | 10/2001 |
| JP | 58-113927 | A | 7/1983 |
| JP | 5-016015 | B2 | 3/1993 |
| JP | 7-232473 | A | 9/1995 |
| JP | 8-132731 | A | 5/1996 |
| JP | 9-066664 | A | 3/1997 |
| JP | 9-076628 | A | 3/1997 |
| JP | 2004-167959 | A | 6/2004 |
| JP | 2005-138403 | A | 6/2005 |

OTHER PUBLICATIONS

May 27, 2011 European Communication in European Patent Appln. No. 11001427.1.
U.S. Appl. No. 13/110,521 filed May 18, 2011, Hiroshi Asakawa, et al.
U.S. Appl. No. 13/111,213 filed May 19, 2011, Masaya Asao, et al.
U.S. Appl. No. 13/112,175 filed May 20, 2011, Takatoshi Tanaka, et al.

* cited by examiner

*Primary Examiner* — Betelhem Shewareged
(74) *Attorney, Agent, or Firm* — Fitzpatrick, Cella, Harper & Scinto

(57) ABSTRACT

A recording medium comprising a substrate and at least two porous ink receiving layers provided thereon of which a lower layer, second distant from the substrate, is arranged on the substrate side of an upper layer, most distant from the substrate. Pore distribution curves of the upper and lower layers respectively have one peak and two peaks. When pore radii giving the one peak and the two peaks are respectively regarded as R1 and R2, R3 where R2 is smaller than R3, R1 is 8 to 11 nm, R2 is 5 nm or more, R2 is smaller than R1, a difference between R1 and R2 is 2 nm or more, R3 is not less than R1, a difference between R3 and R1 is 3 nm or less. When pore volumes at the pore radii of R2 and R3 are respectively $V_{R2}$ and $V_{R3}$, a proportion $V_{R2}/V_{R3}$ is 0.8 to 2.4.

4 Claims, No Drawings

RECORDING MEDIUM

BACKGROUND OF THE INVENTION

1. Field of the Invention

The present invention relates to a recording medium such as an ink jet recording medium.

2. Description of the Related Art

In recent years, printing on a recording medium not only with a dye ink in which a water-soluble dye is dissolved, but also with a pigment ink in which a pigment is dispersed in water has increased. In addition, high-speed recording with the pigment ink has come to be conducted with the current trend of speeding up of recording. Further, a high ink absorption volume has also been required for providing a high-definition printed image. In particular, this requirement is marked in an ink jet recording medium used in recording with an ink jet system.

It has heretofore been investigated as a method for improving the ink absorbency of an ink jet recording medium to cause an ink receiving layer in which an inorganic pigment and polyvinyl alcohol (PVA) are used to have a multilayer structure. Japanese Patent Application Laid-Open No. 2005-138403 discloses a method for improving ink absorbency by causing an ink receiving layer to have a two-layer structure and making a peak pore size (a pore size giving a peak in a pore distribution curve) of an upper layer greater than a peak pore size of a lower layer. Japanese Patent Application Laid-Open No. 2004-167959 discloses a method for improving ink absorbency by causing an ink receiving layer to have a two-layer structure, forming a lower layer in such a manner that its pore distribution curve has at least one peak between pore sizes of 0.1 μm or more and 10 μm or less and controlling a peak pore size of an upper layer to 0.06 μm or less.

SUMMARY OF THE INVENTION

The present inventors have carried out an investigation as to the prior art. As a result, it has been found that the following problems are involved. The method of Japanese Patent Application Laid-Open No. 2005-138403 can meet high-speed recording, but may not satisfy all of the performances of colorability, ink absorption volume and resistance to cracks in some cases. More specifically, when the peak pore size of the upper layer is made small for improving colorability, it is required to make the peak pore size of the lower layer smaller, and it is required to increase the coating amount for sufficiently ensuring an ink absorption volume, so that cracks may have occurred in some cases. When the peak pore size of the lower layer is made somewhat great so as to satisfy the ink absorption volume and resistance to cracks, the upper layer is required to make its peak pore size greater, so that sufficient colorability may have not been achieved in some cases. The method of Japanese Patent Application Laid-Open No. 2004-167959 has the performance capable of sufficiently satisfying the ink absorption volume and resistance to cracks, but may have not achieved sufficiently satisfactory performance in high-speed recording in some cases.

The present invention has been made in view of the foregoing circumstances. It is an object of the present invention to provide a recording medium that does not cause cracks in its porous ink receiving layer, has high ink absorbency and higher ink absorption volume capable of meeting high-speed recording with a pigment ink, which has been an object in recent years, while having excellent colorability in printing with a dye ink.

According to the present invention, there is provided a recording medium comprising a substrate and at least two porous ink receiving layers provided on the substrate, wherein of the porous ink receiving layers a lower layer, which is a layer second distant from the substrate, is arranged on the substrate side of an upper layer, which is a layer most distant from the substrate, wherein a pore distribution curve of the upper layer has one peak and a pore distribution curve of the lower layer has two peaks, wherein when a pore radius giving the peak in the pore distribution curve of the upper layer is regarded as R1 and pore radii giving the two peaks in the pore distribution curve of the lower layer are respectively regarded as R2 and R3, where R2 is smaller than R3, R1 is 8 nm or more and 11 nm or less, R2 is 5 nm or more, R2 is smaller than R1, a difference between R1 and R2 is 2 nm or more, R3 is not less than R1, and a difference between R3 and R1 is 3 nm or less, and wherein when in the pore distribution curve of the lower layer, a pore volume at the pore radius of R2 is $V_{R2}$ and a pore volume at the pore radius of R3 is $V_{R3}$, a proportion of $V_{R2}$ to $V_{R3}$ ($V_{R2}/V_{R3}$) is 0.8 or more and 2.4 or less.

The peak pore radius of the upper layer of the porous ink receiving layer, which is a layer most distant from the substrate, of the porous ink receiving layer used in the recording medium according to the present invention, the two peak pore radii of the lower layer, which is a layer located right under the upper layer, and the peak pore volume of the lower layer are controlled, whereby the following effects can be achieved. A recording medium having high ink absorbency and higher ink absorption volume capable of meeting high-speed recording with a pigment ink while having excellent colorability in printing with a dye ink can be obtained. Incidentally, the peak pore radius means a pore radius giving a peak in a pore distribution curve, and the peak pore volume means a pore volume of a peak in the pore distribution curve (a pore volume in a peak pore size).

Further features of the present invention will become apparent from the following description of exemplary embodiments.

DESCRIPTION OF THE EMBODIMENTS

The recording medium according to the present invention will now be described in detail by preferred embodiments.

Recording Medium

The recording medium according to the present invention has a substrate and at least two porous ink receiving layers provided on the substrate. Among these at least two porous ink receiving layers, a porous ink receiving layer nearest to a surface (most distant from the substrate) is called an upper layer, and a porous ink receiving layer second distant from the substrate is called a lower layer. The lower layer is arranged in contact with the upper layer on the substrate side of the upper layer. A pore distribution curve of the upper layer has one peak at a pore radius R1, a pore distribution curve of the lower layer has 2 peaks in total at pore radii R2 and R3, respectively. A smaller pore radius of the pore radii giving the 2 peaks in the pore distribution curve of the lower layer is referred to as R2, and a greater pore radius of the pore radii giving the 2 peaks is referred to as R3. In short, R2 is smaller than R3. In this case, in the recording medium according to the present invention, R1 is 8 nm or more and 11 nm or less. R2 is 5 nm or more, R2 is smaller than R1, and a difference between R1 and R2 is 2 nm or more. R3 is not less than R1, and a difference between R3 and R1 is 3 nm or less. Incidentally, in the pore distribution curve of the lower layer, a pore volume at the pore radius of R2 is called $V_{R2}$ and a pore volume at the pore radius of R3 is called $V_{R3}$. In this case, a proportion of $V_{R2}$ to $V_{R3}$ ($V_{R2}/V_{R3}$) in the recording medium according to the present invention is 0.8 or more and 2.4 or less.

In addition, the recording medium according to the present invention may have a porous ink receiving layer and an adhesive layer, which are publicly known in the field of recording media such as ink jet recording media, between the substrate and the lower layer. In addition, any other layer such as a protective layer may be provided on the upper layer within limits not impeding the effects of the present invention.

With respect to the ink receiving layers, description will hereinafter be given paying attention to the upper and lower layers. The respective porous ink receiving layers can be prepared with an inorganic pigment and a binder. At this time, the inorganic pigment used in the respective porous ink receiving layers is suitably selected, and a ratio of the inorganic pigment to the binder in each of the porous ink receiving layers is suitably adjusted, whereby the peak pore radii of the respective layers can be controlled so as to be described above. Specifically, the peak pore radii of the porous ink receiving layers used in the respective layers are respectively measured in advance as a single layer, and the layers whose peak pore radii have been already known are combined as the lower layer and upper layer to form the two porous ink receiving layers, whereby the peak pore radii can be controlled. In addition, inorganic pigments of different materials such as alumina hydrate and wet silica are mixed, whereby peaks, i.e., 2 peaks in total, can be given at positions of different pore radii in a pore distribution curve like the lower layer used in the present invention. Incidentally, even in materials of the same kind (for, example, alumina hydrate and alumina hydrate), they may be used in combination so far as they give 2 peaks in a pore distribution curve and can satisfy other requirements of the lower layer. The pore volume resulting from each peak can be controlled by controlling a ratio between inorganic pigments mixed.

Effects brought about by specifying the peak pore radii of the upper and lower layers and the proportion between the peak pore volumes in the lower layer will hereinafter be described.

Capillary force acts within fine pores of a porous ink receiving layer, and so ink penetrates into the pores. In the present invention, the smaller peak pore radius R2 of the lower layer in the two porous ink receiving layers is smaller than the peak pore radius R1 of the upper layer, so that the capillary force of the lower layer becomes greater when the ink has penetrated from the upper layer, and the ink is easier to penetrate into the lower layer to increase the ink absorption rate.

On the other hand, the pore volume generally depends on the pore radius, and the pore volume becomes smaller as the pore radius is smaller.

In the present invention, the pore distribution curve of the lower layer has peaks at 2 different pore radii (R2 and R3), respectively, and the smaller pore radius (R2) of the pore radii giving these peaks is 5 nm or more, and a difference between the peak pore radius (R1) and R2 is 2 nm or more. The greater pore radius (R3) of the pore radii giving the 2 peaks in the pore distribution curve of the lower layer is not less than R1, and a difference between R3 and R1 is 3 nm or less. In the pore distribution curve of the lower layer, a proportion between pore volumes ($V_{R2}/V_{R3}$) resulting from the pore radii giving the respective peaks is 0.8 or more and 2.4 or less.

Therefore, the increase in the ink absorption rate is developed by the relation between the small peak pore radius (R2) of the lower layer and the peak pore radius (R1) of the upper layer, and the lower layer has the great peak pore radius (R3) to produce the high ink absorption volume.

If the difference (R1−R2) between R1 and R2 is less than 2 nm, the capillary force does not sufficiently act between the upper and lower layers. As a result, the sufficient ink absorption rate is not achieved. In addition, the difference (R1−R2) between R1 and R2 is favorably 3 nm or more from the viewpoint of ink absorption rate. If the R2 is less than 5 nm, the pore volume of the resulting ink receiving layer is insufficient to cause ink overflowing.

If the difference (R3−R1) is greater than 3 nm, the increase in the ink absorption rate by the capillary force difference caused by the relation between R1 and R2 is impeded. As a result, lowering of the ink absorption rate is caused failing to achieve a sufficient ink absorption rate.

In addition, if the proportion between the pore volumes ($V_{R2}/V_{R3}$) resulting from the respective peak pore radii of the lower layer is less than 0.8, the contribution of R2 becomes small, so that the increase in the ink absorption rate by the capillary force difference caused by the relation between R1 and R2 is not sufficiently achieved. As a result, the sufficient ink absorption rate is not achieved. If this proportion is greater than 2.4, the high pore volume achieved by $V_{R3}$ is not sufficiently achieved. As a result, the pore volume of the resulting ink receiving layer becomes insufficient to cause ink overflowing.

The difference between R3 and R1 is favorably 2 nm or less. The difference is controlled to 2 nm or less, whereby a sufficient ink absorption rate can be easily achieved without causing impediment in ink absorption between the upper and lower layers.

The proportion between the pore volumes ($V_{R2}/V_{R3}$) resulting from the respective peak pore radii of the lower layer is favorably 1.2 or more and 2.0 or less. The proportion is controlled to 1.2 or more, whereby the contribution of R2 can be made greater, so that it is easy to sufficiently develop the increase in the ink absorption rate by the capillary force difference caused by the relation between R1 and R2, and an excellent ink absorption rate is achieved. The proportion is controlled to 2.0 or less, whereby a higher ink absorption volume can be achieved. Incidentally, the pore radius and pore volume (pore distribution curve) of each porous ink receiving layer are values on the desorption side as respectively determined by a nitrogen absorption/desorption method using TriStar 3000 (trade name, manufactured by SHIMADZU CORP.). Since it is considered that a substrate is not influenced when a pore distribution curve is determined, for example, the pore distribution curve of the lower layer can be obtained by subjecting a recording medium having only the lower layer formed on the substrate to measurement using the above-described measuring apparatus. The pore distribution curve of the upper layer can be obtained by subjecting a recording medium having the upper layer formed directly on the substrate without forming the lower layer to measurement using the above-described apparatus. Incidentally, when whether the requirements of the present invention are satisfied or not is determined with respect to a recording medium, it is only necessary to remove the upper layer and respectively subject the upper layer and the lower layer to the measurement.

The peak pore radius R1 of the porous ink receiving layer of the upper layer is 8 nm or more and 11 nm or less from the viewpoints of ink absorption volume and colorability. The peak pore radius is controlled within this range, whereby the resulting recording medium can have excellent colorability without causing ink overflowing.

If R1 is less than 8 nm, ink overflowing is caused because such an upper layer does not have a sufficient ink absorption volume. If R1 is more than 11 nm, the transparency of such an upper layer is lowered to deteriorate colorability of the resulting recording medium.

R1 is favorably controlled to 9 nm or more. R1 is controlled to 9 nm or more, whereby a sufficient ink absorption volume can be achieved. In other words, R1 is favorably controlled to 9 nm or more and 11 nm or less. In addition, R1 is favorably controlled to 10 nm or less because the colorability of the resulting recording medium is improved. The coating amount of the upper layer after drying is favorably 3 g/m$^2$ or more and 10 g/m$^2$ or less. When the coating amount is 3 g/m$^2$ or more, a better coated surface can be obtained. When the coating amount is 10 g/m$^2$ or less, an excellent effect due to the multilayer structure can be achieved.

The coating amount of the lower layer after drying is favorably 25 g/m$^2$ or more and 35 g/m$^2$ or less. When the coating amount is 25 g/m$^2$ or more, the ink absorbency of the whole of the porous ink receiving layers can be particularly improved to achieve excellent ink absorbency. When the coating amount is 35 g/m$^2$ or less, occurrence of cracks can be more effectively prevented.

The materials used in the recording medium according to the present invention will hereinafter be described in detail.

Substrate

As the substrate, may be favorably used such paper as cast-coated paper, baryta paper or resin-coated paper (resin-coated paper with both surfaces thereof coated with a resin such as polyolefin). In addition, a transparent thermoplastic film formed of polyethylene, polypropylene, polyester, polylactic acid, polystyrene, polyacetate, polyvinyl chloride, cellulose acetate, polyethylene terephthalate, polymethyl methacrylate or polycarbonate may also be favorably used.

Besides the above, waterleaf paper or coat paper that is moderately sized paper, or a sheet-like material (synthetic paper or the like) formed of a film opacified by filling an inorganic material or causing fine foaming may also be used. In addition, a sheet formed of a glass or a metal may also be used. Further, the surfaces of these substrates may also be subjected to a corona discharge treatment or various undercoating treatments for the purpose of improving adhesion strength between such a substrate and an ink-receiving layer.

Among the above-described substrates, the resin-coated paper is favorably used from the viewpoint of quality of a recording medium obtained after the formation of the porous ink receiving layers, such as glossy feeling.

Porous Ink Receiving Layers

The porous ink receiving layers used in the present invention may each contain an inorganic pigment, polyvinyl alcohol (PVA), a crosslinking agent, a pH adjustor and various additives. These components will hereinafter be described in detail.

Inorganic Pigment

The inorganic pigment used in each porous ink receiving layer is favorably at least one of alumina hydrate and silica. These inorganic pigments may be used singly in each layer, or 2 or more different materials (for example, alumina hydrate and silica) may be mixed and used in each layer. Two or more materials of the same kind (for, example, alumina hydrate and alumina hydrate) may also be mixed and used in each layer. As the alumina hydrate, may be favorably used, for example, that represented by the following formula (X):

$$Al_2O_{3-n}(OH)_{2n}.mH_2O \quad (X)$$

wherein n is any one of 1, 2 and 3, and m is a number of 0 or more and 10 or less, favorably 0 or more and 5 or less, with the proviso that m and n are not 0 at the same time. In many cases, $mH_2O$ represents an aqueous phase, which does not participate in the formation of a crystal lattice, but is eliminable. Therefore, m may take a value of an integer or a value other than an integer. When the material of this kind (alumina hydrate) is heated, m may reach a value of 0 in some cases.

As the crystal structure of the alumina hydrate, are known amorphous, gibbsite and boehmite types according to the temperature of a heat treatment. That having any crystal structure among these may be used as the alumina hydrate.

Among these, favorable alumina hydrate is alumina hydrate exhibiting a boehmite structure or amorphous structure when analyzed by X-ray diffractometry. As specific examples thereof, may be mentioned the alumina hydrates described in Japanese Patent Application Laid-Open No. H07-232473, Japanese Patent Application Laid-Open No. H08-132731, Japanese Patent Application Laid-Open No. H09-66664 and Japanese Patent Application Laid-Open No. H09-76628.

Incidentally, the average pore radius and peak pore radius of each porous ink receiving layer are respectively determined by means of the BJH (Barrett-Joyner-Halenda) method from an adsorption/desorption isotherm of nitrogen gas obtained by subjecting a recording medium to measurement by the nitrogen adsorption/desorption method. According to this method, the average pore radius and peak pore radius can be respectively determined by calculation from the whole pore volume measured upon desorption of nitrogen gas and the specific surface area.

With respect to the surface area of the alumina hydrate, alumina hydrate having a BET specific surface area of 100 m$^2$/g or more and 200 m$^2$/g or less as measured by the BET method is favorably used. Alumina hydrate having a BET specific surface area of 125 m$^2$/g or more and 175 m$^2$/g or less is more favorably used.

The BET method is a method for measuring the surface area of powder by a gas-phase adsorption method, and is a method for determining a total surface area that 1 g of a sample has, i.e., a specific surface area, from an adsorption isotherm. In the BET method, nitrogen gas is generally used as an adsorption gas, and a method of measuring an adsorption amount from a change in the pressure or volume of the gas adsorbed is oftenest used. At this time, the Brunauer-Emmett-Teller equation is most marked as that indicating the isotherm of multimolecular adsorption, called the BET equation and widely used in determination of the specific surface area. According to the BET method, the specific surface area is determined by finding an adsorption amount based on the BET equation and multiplying this value by an area occupied by ones molecule adsorbed at the surface.

The favorable shape of the alumina hydrate is such a flat plate that the average aspect ratio is 3.0 or more and 10 or less, and the vertical-to-horizontal ratio of the flat plate surface is 0.60 or more and 1.0 or less. Incidentally, the aspect ratio can be determined according to the method described in Japanese Patent Publication No. H05-16015. More specifically, the aspect ratio is expressed by a ratio of "diameter" to "thickness" of a particle. The term "diameter" as used herein means a diameter of a circle having an area equal to a projected area of the particle (equivalent circle diameter), which has been obtained by observing the alumina hydrate through a microscope or electron microscope. The vertical-to-horizontal ratio of the flat plate surface means a ratio of a diameter indicating a minimum value to a diameter indicating a maximum value in the flat plate surface when the particle is observed through a microscope in the same manner as in the aspect ratio.

When alumina hydrate having an aspect ratio falling within the above range is used, it can be excellently prevented that the pore distribution range of a porous ink receiving layer formed becomes narrow. It can thus be excellently prevented that difficulty arises in forming the porous ink receiving layer with even particle size of alumina hydrate. Even when alumina hydrate having a vertical-to-horizontal ratio falling within the above range is used, it can be excellently prevented likewise that the pore distribution range of the resulting porous ink receiving layer becomes narrow.

PVA

Each porous ink receiving layer may contain PVA (polyvinyl alcohol), and PVA having a saponification degree of 70% or more and 100% or less is favorably used. The total content of PVA in each porous ink receiving layer is favorably controlled to 5 parts by mass or more and 13 parts by mass or less per 100 parts by mass of the inorganic pigment. The total content of PVA in each porous ink receiving layer is more favorably controlled to 7 parts by mass or more and 12 parts by mass or less. The average polymerization degree of PVA is favorably 1,500 or more and 5,000 or less. Plural kinds of PVA may be used singly or in combination of 2 or more thereof in each layer.

Crosslinking Agent

As the crosslinking agent favorably usable in each porous ink receiving layer, that capable of causing a crosslinking reaction with the above-described PVA to cure the PVA is favorable, and any crosslinking agent may be suitably used so far as the effect of the present invention is not impaired. In particular, boric acid is favorable as the crosslinking agent. Examples of usable boric acid include metaboric acid and hypoboric acid in addition to orthoboric acid ($H_3BO_3$). However, orthoboric acid is favorably used from the viewpoints of long-term stability of coating liquids and an effect of inhibiting the occurrence of cracks.

The amount of the boric acid used is favorably within a range of 0.2 equivalents or more and 1.2 equivalents or less based on the PVA in each porous ink receiving layer. With respect to the term "equivalent", the amount of the crosslinking agent theoretically completely reacting with the hydroxyl group of the PVA is regarded as 1.0 equivalent. The amount of the crosslinking agent is controlled within the above range, the long-term stability of the respective coating liquids can be particularly improved. In general, the coating liquid is used over a long period of time upon the formation of the porous ink receiving layer. The content of the boric acid in each coating liquid is controlled within the above range, whereby viscosity increase of the coating liquid and occurrence of gelled products, which are caused during use of the coating liquid for a long period of time, can be excellently prevented. Therefore, replacement of the coating liquid or cleaning of a coater head need not be frequently conducted, so that lowering of productivity of the recording medium such as an ink jet recording medium can be easily prevented. In addition, when the content of the boric acid in the coating liquid falls within the above range, it can be excellently prevented that dotted surface defects are liable to occur on each of the resulting ink receiving layers, and so an uniform and good surface can be obtained.

pH Adjustor

Into the coating liquid for forming each porous ink receiving layer, may be suitably added, as a pH adjustor, for example, any of the following acids: formic acid, acetic acid, glycolic acid, oxalic acid, propionic acid, malonic acid, succinic acid, adipic acid, maleic acid, malic acid, tartaric acid, citric acid, benzoic acid, phthalic acid, isophthalic acid, terephthalic acid, glutaric acid, gluconic acid, lactic acid, asparagic acid, glutamic acid, pimelic acid, suberic acid, methanesulfonic acid, and inorganic acids such as hydrochloric acid, nitric acid and phosphoric acid.

For example, when alumina hydrate is used as the inorganic pigment, a monobasic acid is favorably used for dispersing the alumina hydrate in water. Therefore, among the above-described pH adjustors, an organic acid such as formic acid, acetic acid, glycolic acid or methanesulfonic acid, or an inorganic acid such as hydrochloric acid or nitric acid is favorably used.

Additives

As additives for the coating liquid for each porous ink receiving layer, a pigment dispersant and a fastness improver may be suitably used within limits not greatly changing a contact angle of the surface of the porous ink receiving layer with pure water after the formation of the porous ink receiving layer.

Production Process of Recording Medium

As a production process of the recording medium according to the present invention, may be mentioned, for example, the following process. First, a coating liquid for forming a porous ink receiving layer, which is obtained by mixing an inorganic pigment, polyvinyl alcohol (PVA), crosslinking agent, pH adjustor, various additives and water, is prepared for every layer. The coating liquid for forming the lower layer is applied to the substrate (to another layer when such another layer is provided on the substrate) and dried to form a porous ink receiving layer of the lower layer. The coating liquid for forming the upper layer is then applied to the lower layer and dried to form a porous ink receiving layer of the upper layer, whereby the recording medium according to the present invention can be obtained. Incidentally, the kinds and amounts of these materials (inorganic pigment, PVA, crosslinking agent, pH adjustor, various additives and water) used in the respective porous ink receiving layers may be suitably chosen for use so as to satisfy the requirements of the present invention.

The coating method of the coating liquid for each porous ink receiving layer will now be described.

For example, the following coating method may be used for the coating of the coating liquid for each porous ink receiving layer so as to give a proper coating amount, and the coating is conducted by on-machine or off-machine coating.

Coating by any One of Various Kinds of Curtain Coaters, a Coater Using an Extrusion System and a Coater Using a Slide Hopper System.

Upon the coating, the coating liquid may also be heated for the purpose of adjusting the viscosity of the coating liquid. A coater head may also be heated.

For example, a hot air dryer such as a linear tunnel dryer, arch dryer, air loop dryer or sine curve air float dryer may be used for drying of the coating liquid after the coating. An infrared heating dryer or a dryer utilizing microwaves may also be suitably chosen for use.

EXAMPLES

The present invention will hereinafter be described more specifically by the following Examples. Incidentally, the following Examples are specific embodiments shown for more deeply understanding the present invention, and the present invention is not limited by these embodiments at all.

Example 1

Substrate

A substrate was prepared under the following conditions. A paper stock of the following composition was first adjusted with water so as to give a solid content of 3% by mass.

Composition of Paper Stock

| | |
|---|---|
| Pulp (80 parts by mass of Laulholz bleached kraft pulp (LBKP) having a freeness of 450 ml CSF (Canadian Standard Freeness) and 20 parts by mass of Nadelholz bleached kraft pulp (NBKP) having a freeness of 480 ml CSF) | 100 parts by mass |
| Cationized starch | 0.60 parts by mass |
| Ground calcium carbonate | 10 parts by mass |
| Precipitated calcium carbonate | 15 parts by mass |
| Alkyl ketene dimer | 0.10 parts by mass |
| Cationic polyacrylamide | 0.030 parts by mass. |

Paper was then made from this paper stock by a Fourdrinier paper machine, subjected to 3-stage wet pressing and dried by a multi-cylinder dryer. The resultant paper was then impregnated with an aqueous solution of oxidized starch by a size press machine so as to give an impregnated solid content of 1.0 g/m$^2$ and dried. Thereafter, the paper was subjected to machine calender finishing to obtain a base paper A having a basis weight of 170 g/m$^2$, a Stöckigt sizing degree of 100 seconds, a gas permeability of 50 seconds, a Bekk smoothness of 30 seconds and a Gurley stiffness of 11.0 mN.

A resin composition composed of low density polyethylene (70 parts by mass), high density polyethylene (20 parts by mass) and titanium oxide (10 parts by mass) was applied on the base paper A in an amount of 25 g/m$^2$. A resin composition composed of high density polyethylene (50 parts by mass) and low density polyethylene (50 parts by mass) was further applied on a back side of the base paper A in an amount of 25 g/m$^2$, thereby obtaining a resin-coated substrate.

Production of Ink Jet Recording Medium

Coating liquids for upper and lower layers were successively applied on the substrate and dried to form 2 porous ink receiving layers. At this time, the compositions and coating method of the respective coating liquids are as follows.

Preparation of Colloidal Sol A

Alumina hydrate Disperal HP14 (trade name, product of Sasol Co.) as inorganic alumina hydrate was added to pure water so as to give a solid content of 30% by mass. Methanesulfonic acid was then added in an amount of 1.5 parts by mass per 100 parts by mass of this alumina hydrate, and the resultant mixture was stirred to obtain a colloidal sol. The resultant colloidal sol was suitably diluted with pure water in such a manner that the solid content of the alumina hydrate is 27% by mass, thereby obtaining a colloidal sol A.

Preparation of Colloidal Sol B

Alumina hydrate Disperal HP10 (trade name, product of Sasol Co.) as inorganic alumina hydrate was added to pure water so as to give a solid content of 30% by mass. Methanesulfonic acid was then added in an amount of 2.5 parts by mass per 100 parts by mass of this alumina hydrate, and the resultant mixture was stirred to obtain a colloidal sol. The resultant colloidal sol was suitably diluted with pure water in such a manner that the solid content of the alumina hydrate is 27% by mass, thereby obtaining a colloidal sol B.

Preparation of Colloidal Sol C

Alumina hydrate Disperal HP18 (trade name, product of Sasol Co.) as inorganic alumina hydrate was added to pure water so as to give a solid content of 30% by mass. Methanesulfonic acid was then added in an amount of 1.2 parts by mass per 100 parts by mass of this alumina hydrate, and the resultant mixture was stirred to obtain a colloidal sol. The resultant colloidal sol was suitably diluted with pure water in such a manner that the solid content of the alumina hydrate is 27% by mass, thereby obtaining a colloidal sol C.

Preparation of Colloidal Sol D and E

Silica powder X-37 (trade name, product of TOKUYAMA Corp.) was added to a solution obtained by adding polyaluminum chloride (Takibine, trade name, product of TAKI Chemicals Co.) to pure water in an amount of 2 parts by mass per 100 parts by mass of silica in such a manner that the solid content is 25% by mass. The resultant mixture was dispersed by a high-pressure homogenizer to obtain a colloidal sol. The resultant colloidal sol was suitably diluted with pure water in such a manner that the solid content of the silica powder is 21% by mass, thereby obtaining a colloidal sol D. The silica was dispersed in the same manner as in colloidal sol D except that dispersing conditions by the high-pressure homogenizer were changed, and the solid content of the silica powder was controlled to 21% by mass to obtain a colloidal sol E.

Preparation of Colloidal Sol F, G, H, I and J

Colloidal sol F was obtained by the same preparation process as in colloidal sol D except that silica powder X-37 was changed to silica powder BY-400 (trade name, product of TOSOH SILICA CORPORATION). In addition, colloidal sol G, H, I and J were obtained by the same preparation process as in colloidal sol E except that silica powder X-37 was changed to silica powder X-37B (trade name, product of TOKUYAMA Corp.), silica powder AY-601 (trade name, product of TOSOH SILICA CORPORATION), silica powder AZ-400 (trade name, product of TOSOH SILICA CORPORATION) and silica powder BY-601 (trade name, product of TOSOH SILICA CORPORATION), respectively.

Preparation of Coating Liquid for Lower Layer

Colloidal sol B and colloidal sol D were mixed in such a manner that the mass ratio between the inorganic pigments in the respective sol B and D is 75:25 in terms of solid content. An aqueous solution of polyvinyl alcohol PVA 235 (trade name, product of Kuraray Co., Ltd.) having a concentration of 8.0% by mass was mixed with the mixed sol in such a manner that the solid content of PVA is 10 parts by mass per 100 parts by mass of the solid content of the inorganic pigments in the mixed sol.

An aqueous solution of boric acid having a concentration of 3.0% by mass was then mixed with the resultant mixture in such a manner that the solid content of boric acid is 1.8 parts by mass per 100 parts by mass of the solid content of the inorganic pigments in the mixed sol, thereby obtaining a coating liquid for lower layer.

Preparation of Coating Liquid for Upper Layer

An aqueous solution of polyvinyl alcohol PVA 235 (trade name, product of Kuraray Co., Ltd.) having a concentration of 8.0% by mass was mixed with colloidal sol A in such a manner that the solid content of PVA is 10 parts by mass per 100 parts by mass of the alumina hydrate in colloidal sol A.

An aqueous solution of boric acid having a concentration of 3.0% by mass was then mixed with the resultant mixture in such a manner that the solid content of boric acid is 1.8 parts by mass per 100 parts by mass of the alumina hydrate in colloidal sol A, thereby obtaining a coating liquid for upper layer.

Coating Method of Ink Receiving Layers

The coating liquid for lower layer was applied on to the substrate so as to give a dry coating amount of 30 g/m$^2$ and then dried at 50° C. to form a lower layer. The coating liquid for upper layer was applied on to the lower layer so as to give a dry coating amount of 10 g/m$^2$ and then dried at 50° C. to prepare an ink jet recording medium 1.

Example 2

An ink jet recording medium 2 was prepared in the same manner as in Example 1 except that colloidal sol D used in the coating liquid for lower layer in Example 1 was changed to colloidal sol I.

Example 3

An ink jet recording medium 3 was prepared in the same manner as in Example 1 except that colloidal sol D used in the coating liquid for lower layer in Example 1 was changed to colloidal sol G.

Example 4

An ink jet recording medium 4 was prepared in the same manner as in Example 1 except that colloidal sol B used in the coating liquid for lower layer in Example 1 was changed to mixed sol obtained by mixing colloidal sol A and colloidal sol B in such a manner that a mass ratio between the alumina hydrates in the respective sol A and B is 25:75 in terms of solid content.

Example 5

An ink jet recording medium 5 was prepared in the same manner as in Example 1 except that the mixture of colloidal sols B and D used in the coating liquid for lower layer in Example 1 was changed to a mixed sol obtained by mixing colloidal sol C and colloidal sol J in such a manner that the mass ratio between the inorganic pigments in the respective sol C and J is 35:65 in terms of solid content.

Example 6

An ink jet recording medium 6 was prepared in the same manner as in Example 1 except that the mass ratio between the inorganic pigments in the respective sols of colloidal sol B and colloidal sol D in the mixed sol used in the coating liquid for lower layer in Example 1 was changed to 70:30 from 75:25 in terms of solid content.

Example 7

An ink jet recording medium 7 was prepared in the same manner as in Example 1 except that the mass ratio between the inorganic pigments in the respective sols of colloidal sol B and colloidal sol D of the mixed sol used in the coating liquid for lower layer in Example 1 was changed to 78:22 from 75:25 in terms of solid content.

Example 8

An ink jet recording medium 8 was prepared in the same manner as in Example 1 except that the mass ratio between the inorganic pigments in the respective sols of colloidal sol B and colloidal sol D of the mixed sol used in the coating liquid for lower layer in Example 1 was changed to 65:35 from 75:25 in terms of solid content.

Example 9

An ink jet recording medium 9 was prepared in the same manner as in Example 1 except that the mass ratio between the inorganic pigments in the respective sols of colloidal sol B and colloidal sol D of the mixed sol used in the coating liquid for lower layer in Example 1 was changed to 80:20 from 75:25 in terms of solid content.

Example 10

An ink jet recording medium 10 was prepared in the same manner as in Example 1 except that the mass ratio between the inorganic pigments in the respective sols of colloidal sol B and colloidal sol D of the mixed sol used in the coating liquid for lower layer in Example 1 was changed to 60:40 from 75:25 in terms of solid content.

Example 11

An ink jet recording medium 11 was prepared in the same manner as in Example 1 except that the mass ratio between the inorganic pigments in the respective sols of colloidal sol B and colloidal sol D of the mixed sol used in the coating liquid for lower layer in Example 1 was changed to 82:18 from 75:25 in terms of solid content.

Example 12

An ink jet recording medium 12 was prepared in the same manner as in Example 1 except that the mixed sol of colloidal sol B and colloidal sol D used in the coating liquid for lower layer in Example 1 was changed to a mixed sol obtained by mixing colloidal sol A and colloidal sol J in such a manner that the mass ratio between the inorganic pigments in the respective sols A and J is 30:70 in terms of solid content.

Example 13

An ink jet recording medium 13 was prepared in the same manner as in Example 1 except that the mixed sol of colloidal sol B and colloidal sol D used in the coating liquid for lower layer in Example 1 was changed to a mixed sol obtained by mixing colloidal sol A, colloidal sol B and colloidal sol G in such a manner that the mass ratio among the inorganic pigments in the respective sols A, B and G is 10:40:50 in terms of solid content.

Example 14

An ink jet recording medium 14 was prepared in the same manner as in Example 1 except that colloidal sol D used in the coating liquid for lower layer in Example 1 was changed to colloidal sol I, and colloidal sol A used in the coating liquid for upper layer in Example 1 was changed to a mixed sol obtained by mixing colloidal sol A and colloidal sol B in such a manner that the mass ratio between the alumina hydrates in the respective sols A and B is 70:30 in terms of solid content.

Example 15

An ink jet recording medium 15 was prepared in the same manner as in Example 1 except that colloidal sol A used in the coating liquid for upper layer in Example 1 was changed to a mixed sol obtained by mixing colloidal sol A and colloidal sol C in such a manner that the mass ratio between the alumina hydrates in the respective sols A and C is 75:25 in terms of solid content.

Example 16

An ink jet recording medium 16 was prepared in the same manner as in Example 1 except that the mixed sol of colloidal sol B and colloidal sol D used in the coating liquid for lower layer in Example 1 was changed to a mixed sol obtained by mixing colloidal sol A and colloidal sol J in such a manner that the mass ratio between the respective sols A and J is 35:65 in terms of solid content, and colloidal sol A used in the coating liquid for upper layer in Example 1 was changed to a mixed sol obtained by mixing colloidal sol A and colloidal sol B in such a manner that the mass ratio between the alumina hydrates in the respective sols A and B is 30:70 in terms of solid content.

Incidentally, in each of Examples 1 to 16, one peak appeared in a pore distribution curve of the upper layer, and two peaks appeared in a pore distribution curve of the lower layer.

Comparative Example 1

An ink jet recording medium 17 was prepared in the same manner as in Example 1 except that colloidal sol D used in the coating liquid for lower layer in Example 1 was changed to colloidal sol E.

Comparative Example 2

An ink jet recording medium 18 was prepared in the same manner as in Example 1 except that colloidal sol D used in the coating liquid for lower layer in Example 1 was changed to colloidal sol H.

Comparative Example 3

An ink jet recording medium 19 was prepared in the same manner as in Example 1 except that the mixed sol of colloidal sol B and colloidal sol D used in the coating liquid for lower layer in Example 1 was changed to a mixed sol obtained by mixing colloidal sol C and colloidal sol F in such a manner that the mass ratio between the inorganic pigments in the respective sol C and F is 35:65 in terms of solid content.

Comparative Example 4

An ink jet recording medium 20 was prepared in the same manner as in Example 1 except that the mixed sol of colloidal sol B and colloidal sol D used in the coating liquid for lower layer in Example 1 was changed to a mixed sol obtained by mixing colloidal sol A and colloidal sol D in such a manner that the mass ratio between the respective sols A and D is 55:45 in terms of solid content, and colloidal sol A used in the coating liquid for upper layer in Example 1 was changed to a mixed sol obtained by mixing colloidal sol A and colloidal sol C in such a manner that the mass ratio between the alumina hydrates in the respective sols A and C is 75:25 in terms of solid content.

Comparative Example 5

An ink jet recording medium 21 was prepared in the same manner as in Example 1 except that the mass ratio between the inorganic pigments in the respective sols of colloidal sol B and colloidal sol D of the mixed sol used in the coating liquid for lower layer in Example 1 was changed to 55:45 from 75:25 in terms of solid content.

Comparative Example 6

An ink jet recording medium 22 was prepared in the same manner as in Example 1 except that the mass ratio between the inorganic pigments in the respective sols of colloidal sol B and colloidal sol D of the mixed sol used in the coating liquid for lower layer in Example 1 was changed to 84:16 from 75:25 in terms of solid content.

Comparative Example 7

An ink jet recording medium 23 was prepared in the same manner as in Example 1 except that the mixed sol of colloidal sol B and colloidal sol D used in the coating liquid for lower layer in Example 1 was changed to a single sol of colloidal sol B, and colloidal sol D was not added to the coating liquid for lower layer.

Comparative Example 8

An ink jet recording medium 24 was prepared in the same manner as in Example 1 except that the mixed sol of colloidal sol B and colloidal sol D used in the coating liquid for lower layer in Example 1 was changed to a single sol of colloidal sol C, and colloidal sol B and colloidal sol D were not added to the coating liquid for lower layer.

Comparative Example 9

An ink jet recording medium 25 was prepared in the same manner as in Example 1 except that the mixed sol of colloidal sol B and colloidal sol D used in the coating liquid for lower layer in Example 1 was changed to a single sol of colloidal sol A, and colloidal sol B and colloidal sol D were not added to the coating liquid for lower layer.

Comparative Example 10

An ink jet recording medium 26 was prepared in the same manner as in Example 1 except that the mixed sol of colloidal sol B and colloidal sol D used in the coating liquid for lower layer in Example 1 was changed to a mixed sol obtained by mixing colloidal sol A and colloidal sol J in such a manner that the mass ratio between the respective sol A and J is 35:65 in terms of solid content, and colloidal sol A used in the coating liquid for upper layer in Example 1 was changed to colloidal sol B.

Comparative Example 11

An ink jet recording medium 27 was prepared in the same manner as in Example 1 except that colloidal sol D used in the coating liquid for lower layer in Example 1 was changed to colloidal sol E, and colloidal sol A used in the coating liquid for upper layer in Example 1 was changed to colloidal sol C.

Incidentally, in each of Comparative Examples 7 to 9, one peak appeared in each pore distribution curve of the upper and lower layers. In each of Comparative Examples 1 to 6, 10 and 11, one peak appeared in a pore distribution curve of the upper layer, and two peaks appeared in a pore distribution curve of the lower layer.

Measuring Method of Peak Pore Radius and Peak Pore Volume of Porous Ink Receiving Layer The following apparatus were used in the measurement.

Measurement of peak pore radius: Automatic specific surface area/pore distribution measuring apparatus TriStar 3000 (trade name, manufactured by SHIMADZU CORP.).

Pretreatment of sample: VacPrep 061 (trade name, manufactured by SHIMADZU CORP.).

The measurement was conducted in the following manner. A recording medium with only a lower layer formed according to the process described in Examples and Comparative Examples was cut into a size of 5.0×10 cm, and this cut recording medium was then cut into a size capable of being put in a ⅜-in cell. This piece was put into the cell, and degassed and dried until reaching 2.7 Pa (20 mTorr) or lower by means of VacPrep 061 (trade name) while heating to 80° C.

The sample degassed and dried was subjected to measurement by a nitrogen absorption/adsorption method using TriStar 3000 (trade name). After the measurement, the data obtained on the desorption side was used to finally obtain a peak pore radius and a peak pore volume.

With respect to the peak pore radii of the upper layers formed with colloidal sol A, B or C in Tables 1 and 2, which will be described subsequently, measured results of the lower layer formed with colloidal sol A, B or C in Comparative Example 9, 7 or 8 were shown. With respect to the peak pore radii of the upper layers formed with colloidal sol A and B in Examples 14 and 16, and the peak pore radii of the upper layers formed with colloidal sol A and C in Examples 15 and Comparative Example 4, samples with only the upper layer applied on to the substrate used in the present invention were separately prepared and subjected to the measurement. Incidentally, the unit of R1 to R3 shown in Tables 1 and 2 is nm.

Evaluating Methods

Ink Absorption Rate

Inks for a pigment ink printer (trade name: PIXUS Pro9500, manufactured by Canon Inc.) were refilled into exclusive ink tanks for a photo printer (trade name: PIXUS iP8600, manufactured by Canon Inc.) using an ink jet system. Tone patches of red, green and blue those are secondary colors were printed at 0% duty to 200% duty on a recording surface of each of the ink jet recording media prepared with the super photo paper mode (standard setting). The printed areas were then visually observed to conduct evaluation as follows.

A: No beading is observed even at 150% duty;

B: No beading is observed at 135% duty, but beading is observed at 150% duty;

C: No beading is observed at 120% duty, but beading is observed at 135% duty;

D: Beading is observed even at 120% duty.

Ink Absorption Volume

The same tone patches as in the evaluating method of the ink absorption rate were printed on each of the ink jet recording media prepared by the same method. The printed areas were then visually observed to conduct evaluation as follows.

A: No ink overflowing is observed even at 200% duty;

B: No is observed at 185% duty, but ink overflowing is observed at 200% duty;

C: No ink overflowing is observed at 170% duty, but ink overflowing is observed at 185% duty;

D: Ink overflowing is observed even at 170% duty.

Colorability

A photo printer (trade name: PIXUS iP8600, manufactured by Canon Inc.) using an ink jet system was used to print solid patches of black, cyan, magenta and yellow at 100% duty on each of the ink jet recording media prepared. After stored for 3 days in an environment of 25° C. and 50% RH (relative humidity), colorimetry was conducted by means of a spectrophotometer Spectrolino (trade name; manufactured by Gretag Macbeth Co.) to evaluate the recording media as to O.D. (optical density) values. Incidentally, the evaluation criteria at this time was as follows.

A: The O.D. value is 2.20 or more, and the tone reproduction at a high density portion is very good;

B: The O.D. value is 2.05 or more and less than 2.20, and the tone reproduction at a high density portion is somewhat poorer than A;

C: The O.D. value is less than 2.05, the tone reproduction at a high density portion is poor, and a printing density is thin.

The evaluation results of the recording media prepared in Examples and Comparative Examples are shown in Tables 1 and 2. Incidentally, it was visually confirmed that no crack occurred on all the recording media in Examples 1 to 16 and Comparative Examples 1 to 11.

TABLE 1

| | R1 | R2 | R3 | $V_{R2}/V_{R3}$ | Ink absorption rate | Ink absorption volume | Colorability |
|---|---|---|---|---|---|---|---|
| Ex. 1 | 10 | 7 | 12 | 1.6 | A | A | A |
| Ex. 2 | 10 | 7 | 10 | 1.6 | A | B | A |
| Ex. 3 | 10 | 7 | 13 | 1.6 | B | A | A |
| Ex. 4 | 10 | 8 | 12 | 1.6 | B | A | A |
| Ex. 5 | 10 | 5 | 12 | 1.6 | A | B | A |
| Ex. 6 | 10 | 7 | 12 | 1.2 | A | A | A |
| Ex. 7 | 10 | 7 | 12 | 2.0 | A | A | A |
| Ex. 8 | 10 | 7 | 12 | 1.1 | B | A | A |
| Ex. 9 | 10 | 7 | 12 | 2.1 | A | B | A |
| Ex. 10 | 10 | 7 | 12 | 0.8 | B | A | A |
| Ex. 11 | 10 | 7 | 12 | 2.4 | A | B | A |
| Ex. 12 | 10 | 5 | 10 | 2.4 | A | B | A |
| Ex. 13 | 10 | 8 | 13 | 0.8 | B | A | A |
| Ex. 14 | 9 | 7 | 10 | 1.6 | A | A | A |
| Ex. 15 | 11 | 7 | 12 | 1.6 | A | A | B |
| Ex. 16 | 8 | 5 | 10 | 1.6 | A | B | A |

TABLE 2

| | R1 | R2 | R3 | $V_{R2}/V_{R3}$ | Ink absorption rate | Ink absorption volume | Colorability |
|---|---|---|---|---|---|---|---|
| Comp. Ex. 1 | 10 | 7 | 14 | 1.6 | C | A | A |
| Comp. Ex. 2 | 10 | 7 | 9 | 1.6 | A | C | A |
| Comp. Ex. 3 | 10 | 4 | 12 | 1.6 | A | C | A |
| Comp. Ex. 4 | 11 | 10 | 12 | 1.6 | C | A | B |
| Comp. Ex. 5 | 10 | 7 | 12 | 0.7 | C | A | A |
| Comp. Ex. 6 | 10 | 7 | 12 | 2.5 | A | C | A |
| Comp. Ex. 7 | 10 | 7 | — | — | A | D | A |
| Comp. Ex. 8 | 10 | — | 12 | — | D | A | A |
| Comp. Ex. 9 | 10 | 10 | — | — | C | A | A |
| Comp. Ex. 10 | 7 | 5 | 10 | 1.6 | B | C | A |
| Comp. Ex. 11 | 12 | 7 | 14 | 1.6 | A | A | C |

According to the present invention, a recording medium that can prevent occurrence of cracks in its porous ink receiving layers can be provided. In addition, a recording medium having high ink absorbency and higher ink absorption volume capable of meeting high-speed recording with a pigment ink while having excellent colorability in printing with a dye ink can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-046402, filed Mar. 3, 2010, which is hereby incorporated by reference herein in its entirety.

What is claimed is:

1. A recording medium comprising a substrate and at least two porous ink receiving layers provided on the substrate, wherein of the porous ink receiving layers a lower layer, which is a layer second distant from the substrate, is arranged on the substrate side of an upper layer, which is a layer most distant from the substrate, wherein a pore distribution curve of the upper layer has one peak and a pore distribution curve of the lower layer has two peaks, wherein when a pore radius giving the peak in the pore distribution curve of the upper layer is regarded as R1 and pore radii giving the two peaks in the pore distribution curve of the lower layer are respectively regarded as R2 and R3, where R2 is smaller than R3, R1 is 8 nm or more and 11 nm or less, R2 is 5 nm or more, R2 is smaller than R1, a difference between R1 and R2 is 2 nm or more, R3 is not less than R1, and a difference between R3 and R1 is 3 nm or less, and wherein when in the pore distribution curve of the lower layer, a pore volume at the pore radius of R2 is $V_{R2}$ and a pore volume at the pore radius of R3 is $V_{R3}$, a proportion of $V_{R2}$ to $V_{R3}$ ($V_{R2}/V_{R3}$) is 0.8 or more and 2.4 or less.

2. The recording medium according to claim 1, wherein a difference between R3 and R1 is 2 nm or less.

3. The recording medium according to claim 1, wherein the proportion of $V_{R2}$ to $V_{R3}$ ($V_{R2}/V_{R3}$) is 1.2 or more and 2.0 or less.

4. The recording medium according to claim 1, wherein R1 is 9 nm or more and 11 nm or less.

* * * * *